US006828947B2

(12) United States Patent
Apostolos et al.

(10) Patent No.: US 6,828,947 B2
(45) Date of Patent: Dec. 7, 2004

(54) NESTED CAVITY EMBEDDED LOOP MODE ANTENNA

(75) Inventors: John T. Apostolos, Merrimack, NH (US); Steven A. Hedges, Nashua, NH (US)

(73) Assignee: AE Systems Information and Electronic Systems Intergation Inc., Nashua, NH (US)

( * ) Notice: Subject to any disclaimer, the term of this patent is extended or adjusted under 35 U.S.C. 154(b) by 0 days.

(21) Appl. No.: 10/405,147

(22) Filed: Apr. 3, 2003

(65) Prior Publication Data

US 2004/0201532 A1 Oct. 14, 2004

(51) Int. Cl.[7] ..... H01Q 1/36
(52) U.S. Cl. ..... 343/895
(58) Field of Search ..... 343/895, 700, 343/742, 789, 821, 866

(56) References Cited

U.S. PATENT DOCUMENTS

| | | | | | |
|---|---|---|---|---|---|
| 4,381,566 | A | * | 4/1983 | Kane | 455/193.3 |
| 4,853,704 | A | | 8/1989 | Apostolos | |
| 4,987,424 | A | * | 1/1991 | Tamura et al. | 343/795 |
| 5,198,826 | A | * | 3/1993 | Ito | 343/726 |
| 5,790,080 | A | | 8/1998 | Apostolos | |
| 5,892,490 | A | * | 4/1999 | Asakura et al. | 343/895 |
| 6,094,179 | A | * | 7/2000 | Davidson | 343/895 |
| 6,204,827 | B1 | * | 3/2001 | Endo et al. | 343/895 |
| 6,313,716 | B1 | | 11/2001 | Apostolos | |
| 6,323,814 | B1 | | 11/2001 | Apostolos | |
| 6,373,440 | B2 | | 4/2002 | Apostolos | |
| 6,373,446 | B2 | | 4/2002 | Apostolos | |
| 6,404,391 | B1 | | 6/2002 | Apostolos | |
| 6,429,829 | B1 | * | 8/2002 | Hirai et al. | 343/895 |
| 6,480,158 | B2 | | 11/2002 | Apostolos | |
| 6,492,953 | B2 | | 12/2002 | Apostolos | |
| 6,677,907 | B2 | * | 1/2004 | Shoji et al. | 343/702 |
| 2001/0048390 | A1 | * | 12/2001 | Nagumo et al. | 343/700 OMS |
| 2002/0118142 | A1 | * | 8/2002 | Wang | 343/895 |
| 2003/0137457 | A1 | * | 7/2003 | McKinzie et al. | 343/700 OMS |
| 2004/0001023 | A1 | * | 1/2004 | Peng | 343/725 |

* cited by examiner

*Primary Examiner*—Don Wong
*Assistant Examiner*—Huedung X Cao
(74) *Attorney, Agent, or Firm*—Daniel J. Long; Robert K. Tendler

(57) ABSTRACT

A nested cavity embedded loop mode antenna is provided with an ultra wide band response by nesting individual embedded cavity meander line loaded antenna modules, with the meander lines coupled to a ground plane plate either capacitively or directly so as to provide as much as a 27:1 ratio of high frequency to low frequency cutoff. The nested meander line structure is exceptionally compact and eliminates the problem of a null in the antenna radiation pattern perpendicular to the face of the antenna, thus to provide a loop type antenna pattern at all frequencies across which the antenna is to be operated. The use of the nested meander line configuration provides a flush mount for the antenna having a footprint associated with the larger of the meander line cavities and thus the lowest frequency of operation, the nesting precluding the necessity of providing separate side-by-side meander line loaded antennas which would increase the real estate required.

19 Claims, 5 Drawing Sheets

NESTED CAVITY EMBEDDED LOOP MODE ANTENNA

FIELD OF INVENTION

This invention relates to meander line antennas and more particularly to a nested meander line antenna configuration for providing ultra wide bandwidth.

BACKGROUND OF THE INVENTION

As described in U.S. patent application Ser. No. 10/251,131, filed Sep. 20, 2002 by John T. Apostolos assigned to the assignee hereof and incorporated herein by reference, a wide band meander line antenna is configured to be flush mounted to a conductive surface serving as a ground plane by embedding the meander line components within a conductive cavity surrounded at its top edge by the ground plane. This is done with the antenna looking out of the cavity recessed in the surface. By permitting flush mounting of a meander line antenna, not only can the antenna dimensions be minimized due to the use of the meander line loaded antenna configuration, but in aircraft applications no part of the antenna exists above the skin of the aircraft, thereby to minimize turbulence flow.

Moreover, when adapted to wireless handsets or laptop computers, the depth or thickness of the unit need not be increased when providing a wide band antenna, thus to minimize the overall dimensions of the device. Additionally, the flush mounted meander line antenna when utilized in a roof such as in a car does not result in an unsightly protrusion from the top of the car, but rather is hidden in the recessed cavity. This permits that a vehicle can be provided with a wide band antenna that covers not only cellular frequencies but also the PCS band, 802.11, and GPS frequencies.

Such an embedded antenna is based on the meander line loaded antenna described in U.S. Pat. No. 6,323,814 by John T. Apostolos and assigned to the assignee of incorporated herein by reference. It is noted that in this patent a wide bandwidth miniaturized antenna can be provided through the utilization of planner conductors which are feed through a so-called meander line which involves impedance changes to reduce the physical size of the antenna while at the same time permitting wide band operation.

The plates of the meander line loaded antenna are configured to exist above a ground plane and are spaced therefrom, with a meander line connecting its top plate or element to the ground plane.

Note that the low frequency cut off meander line loaded antennas described in U.S. Pat. No. 6,323,814 and more particularly the meander line loaded antenna described in co-pending patent application Ser. No. 10/123,787, filed Apr. 16, 2002 are assigned to the assignee hereof and are incorporated herein by reference. The low frequency cut off these meander line loaded antennas is decreased due to a cancellation of the reactance of the antenna by the reactance of the meander line and parasitic capacitance.

While the above summarizes the availability of embedded meander line loaded antennas, it will be appreciated that the bandwidth of such antennas is normally no better than 3:1, a ratio of the highest frequency to the lowest frequency of the antenna.

While such an antenna may be made to operate in the 30 to 90 MHz region of the electromagnetic spectrum, there is a requirement to have the bandwidth of the antenna extend between 30 and 500 MHz, a ratio of 18:1.

Moreover, for automotive applications it is sometimes necessary to go from 800 MHz, the cellular band, all the way up to 6,000 MHz for various applications. It will be appreciated that there is no single-cavity meander line loaded antenna which has such an ultra wide bandwidth.

Pushing the upper frequency limit is a problem while maintaining the low frequency cut off. There is a serious problem if one were to try to extend the upper limit of a wide band embedded meander line loaded antenna in terms of its radiation pattern. While the desired radiation pattern from such an antenna would be a loop type pattern or in general omni-directional, when the depth of the cavity is increased to lower the low frequency cut off of the antenna, there is a significant null in the radiation pattern at the higher frequencies which is normal to or perpendicular to the face of the antenna.

Thus, if when one tries to widen the bandwidth of the cavity embedded meander line loaded antenna, as one goes up in the frequency the cavity depth increases. However, with a depth increase one obtains a null in the straight up direction or the direction normal to the plane of the top plate of the antenna.

What this means is that when trying to devise an ultra wide band antenna, the null in the direction perpendicular to the face of the antenna prevents omni directional radiation patterns and thus prevents the antenna from operating properly when it is directly above either a radiating source or when the antenna is used as a transmitting antenna to project energy downwardly in the direction of the null of the antenna pattern.

SUMMARY OF THE INVENTION

In order to solve the problem of the null in the orthogonal direction while at the same time providing an exceptionally compact ultra wide band antenna, what one does is to nest and serially connect antenna modules through a common feed, with each module operating in a separate contiguous band to provide continuous coverage. For instance, one antenna module might go from 270 to 500 MHz, where the next module would go from 90 to 270 MHz and a third one from 30 to 90 MHz to provide a 30 to 500 MHz bandwidth. Thus, one way to establish wide bandwidth operation over such a range is to provide three embedded meander line loaded antenna modules working respectively at 30 to 90 MHz, 90 to 270 MHz and 270 to 500 MHz. Note that each of these antenna modules provides a trap so that as one increases frequency. Successive modules come into play by having only the appropriate antenna module radiating energy.

As will be seen, in one embodiment these antenna modules are cavity embedded meander line loaded antennas. In a further embodiment these cavity embedded meander line loaded antennas are nested. This provides a compact miniaturized design with some significant advantages or attributes.

In operation, in the above example when driving this antenna at a frequency between 270 and 500 MHz the first serially-connected module absorbs all the energy, meaning that very little of the energy is transmitted by the 90 to 270 MHz module or the 30 to 90 MHz module. This means that these modules do not contribute to the antenna radiation pattern and thus there is no null.

Moreover, when the frequency goes down from 270 to 90 MHz there is a transition region. For instance, in the transition region half of the power is radiated by the first module, with the second half being radiated by the second module. This occurs at the frequency transition between the adjacent modules. As one moves further lower from 270 MHz all of the energy is radiated by the second module, with the first and third modules radiating little if any energy. In this manner the modules act as antenna traps.

One of the important factors is that as one transits from one module to the next adjacent module one does not want the energy radiated from one module to be out of phase with the energy radiated by the other module. One therefore wants a smooth transition between the modules. What is needed is a geometry associated with modules which accomplishes the transition without frequency domain distortion and this is provided by the subject nesting.

What is therefore provided is a unitary structure that can be made compact and which has a bandwidth defined by the sum of the bandwidths of the nested meander line loaded antenna modules. The nesting removes the problem of driving a given embedded cavity meander line loaded antenna at such a high frequency that a null in the orthogonal direction is created. The nesting of the meander line loaded antenna modules thus provides an ultra bandwidth antenna with a loop like omni directional radiation pattern.

The nesting also minimizes the real estate occupied by such an antenna so that an ultra wide band antenna may be provided embedded into the skin of an aircraft yet still operate over an exceedingly wide frequency band.

More particularly, in order to provide an ultra wide response to a meander line antenna, a series of separate meander line loaded antennas which are cavity embedded are nested, one in side of the other, with the meander lines for the various adjacent bands being coupled to the top ground plates of the antenna, either by capacitive coupling or by direct coupling.

It has been found that by so doing, the effective radiation pattern for the antenna over the entire ultra wide bandwidth is omni-directional or loop like, with any null in the direction normal to the face of the antenna being eliminated.

The bandwidth of such an antenna can be arbitrarily wide depending on the number of nested meander line loaded antenna components that are serially coupled together. Note that all of the antenna modules have a common feed. The use of a number of meander line loaded antenna components nested one within the other, eliminates the orthogonal null that would be created if one were to try to use only one embedded cavity meander line loaded antenna and drive it to higher frequencies. This means that for an original allocation of real estate, for instance, on an aircraft, an antenna may be provided with an exceedingly wide band response through the subject nesting.

In one embodiment, the innermost of the nested cavity embedded meander line loaded antennas has a portion of its meander line capacitively coupled to an overlying ground plane plate. The next outer cavity embedded meander line loaded antenna has a portion of its meander line also capacitively coupled to the ground plane plate. The last of the nested cavity embedded meander line loaded antennas has its upper most meander line portion directly coupled to the ground plane plate.

In one embodiment, the common feed for such a nested arrangement goes up through the nested cavities, and when balanced is coupled across the innermost portions of opposed ground planes.

While there are critical military requirements for ultra wide band flush mounted antennas for use on aircraft, military vehicles and the like, the ultra wide bandwidth of such antennas is also critical in wireless devices including wireless LANS, laptop antennas and all manner of multi-band operation including ultra wide band transmissions.

In summary, a nested cavity embedded loop mode antenna is provided with an ultra wide band response by nesting individual embedded cavity meander line loaded antenna modules, with the meander lines coupled to a ground plane plate either capacitively or directly so as to provide as much as a 27:1 ratio of high frequency to low frequency cutoff. The nested meander line structure is exceptionally compact and eliminates the problem of a null in the antenna radiation pattern perpendicular to the face of the antenna, thus to provide a loop type antenna pattern at all frequencies across which the antenna is to be operated. The use of the nested meander line configuration provides a flush mount for the antenna having a footprint associated with the larger of the meander line cavities and thus the lowest frequency of operation, the nesting precluding the necessity of providing separate side-by-side meander line loaded antennas which would increase the real estate required.

BRIEF DESCRIPTION OF THE DRAWINGS

These and other features of the subject invention will be better understood in connection with the Detailed Description in conjunction with the Drawings, of which.

DETAILED DESCRIPTION

Figure 1:
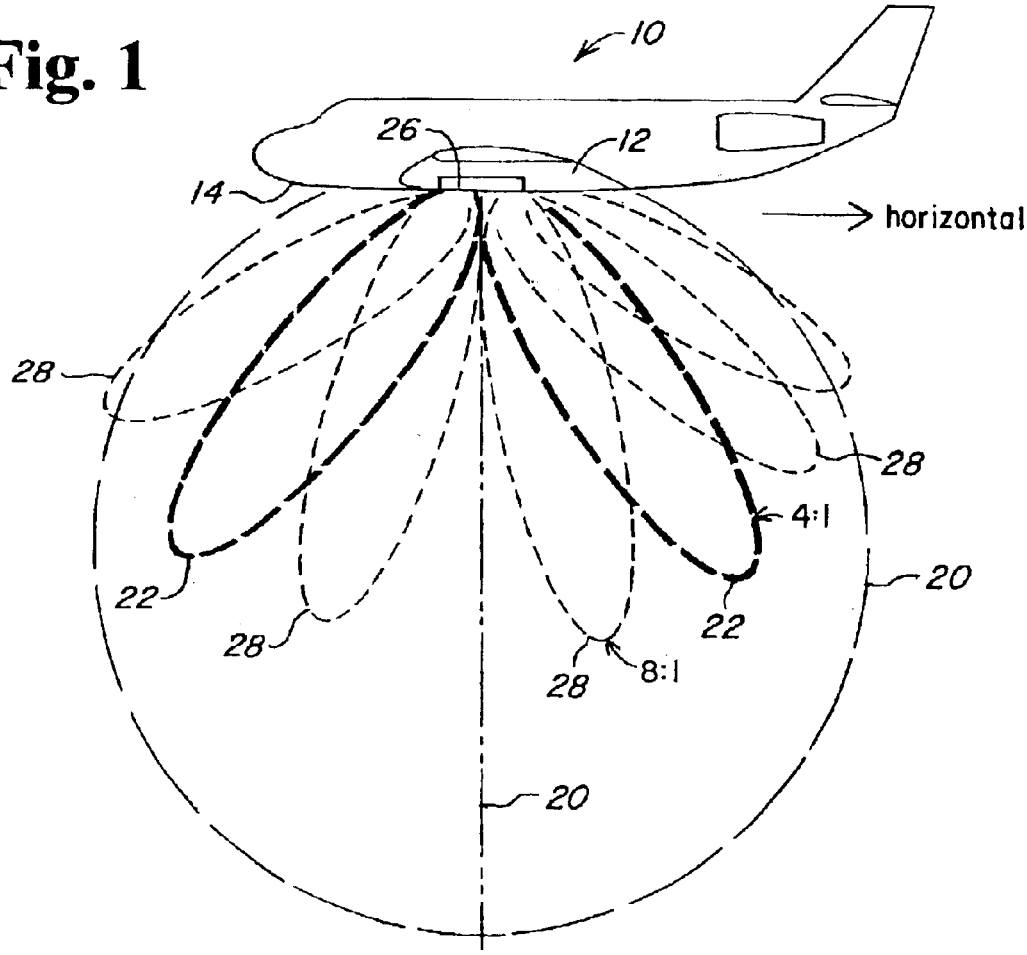
FIG. 1 is a diagrammatic representation of the utilization of an ultra wide band antenna for communications between an over flying aircraft and the ground, or for surveillance, in which the desired antenna radiation pattern is a loop type pattern, whereas the undesired radiation pattern includes a number of lobes resulting in a significant null directly underneath the aircraft.

Referring now to FIG. 1, in one application for an ultra wide band antenna, an aircraft 10 carries an antenna 12 on the under surface 14 thereof, with purpose of the antenna to either transmit energy toward the surface of the earth or to receive radio frequency energy generated at the surface of the earth.

There are a number of things that are highly desirable in such an application. First, the antenna itself should be embedded within the fuselage of the aircraft so as to minimize wind resistance. Secondly, the antenna should be a small as possible so as to take up as little real estate as possible on the aircraft. This is because of the already cluttered environment due to the multitasking of the aircraft. Thirdly, the antenna pattern should have a loop type antenna pattern which in some cases resembles half of a dipole antenna pattern, but importantly has a significant portion of the lobe extent in the horizontal direction as well as the vertical direction.

Most importantly, the antenna used on the aircraft must be an ultra wide band antenna, meaning that in one embodiment the operating frequency of the antenna should be for instance between 30 MHz and 500 MHz. This type of ultra wide band performance permits surveillance over a wide range of frequencies, permits spread spectrum frequency hopping over a wide range of frequencies and in general provides an antenna which can operate in a number of different applications.

As mentioned hereinbefore, a cavity embedded meander line loaded antenna has been provided which can be embedded into the skin of an aircraft. The prior embedded meander line loaded antenna has a moderately wide band response, typically between 30 and 90 MHz. However, for the above noted applications, it is highly desirable to extend the bandwidth of the antenna from the 30 MHz all the way up to 500 MHz.

The typical ratio of a conventional wide band cavity embedded meander line loaded antenna is 3:1, meaning that the top cutoff frequency is 3 times that of the low cutoff frequency. However, with a 30 to 500 MHz desirable bandwidth, a ratio of 18 to 1 is required. In fact it would be extremely desirable to be able to extend the upper frequency limit of such a cavity embedded meander line loaded antenna as much as desired for various applications. Indeed, with the subject nested cavity embedded meander line loaded antenna and techniques to be described, a 27 to 1 ratio has been achieved.

Referring back to FIG. 1, the desired loop antenna pattern is illustrated at 20. However, as one seeks to increase the high frequency cutoff of a cavity embedded meander line loaded antenna, at the higher frequencies for instance at 4:1, two lobes, here illustrated at 22, exist for the higher frequencies. As will be seen the result is a significant null at a direction 24 perpendicular to the face 26 of the cavity embedded meander line loaded antenna.

As one seeks to extend the upper frequency cutoff for such an antenna to for instance 8:1, then four lobes here illustrated at 28 exist at the higher frequencies, again resulting in a significant downwardly pointing null 24.

Figure 2:
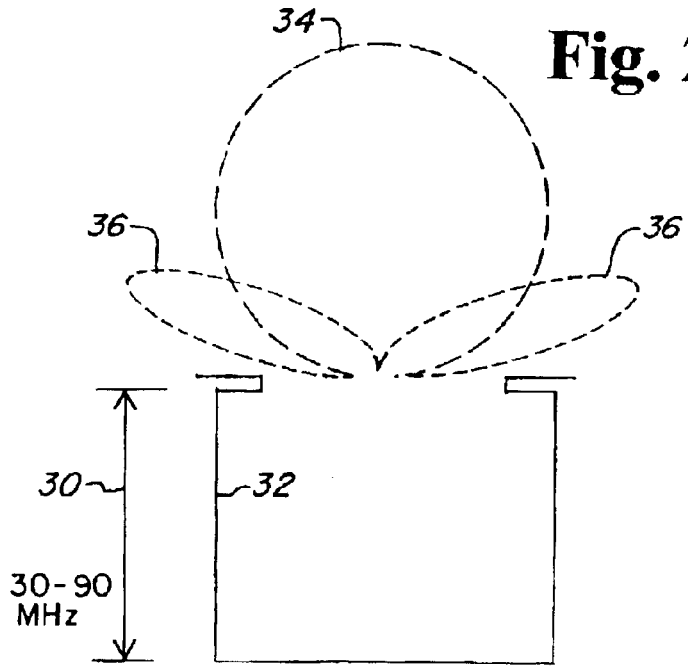
FIG. 2 is a diagrammatic representation of the result of trying to extend the upper frequency limit of a cavity embedded meander line loaded antenna when using the deep cavity associated with a low frequency cut off.

Referring to FIG. 2, the null production is a function of the depth 30 of the cavity 32 of a meander line loaded antenna. Here it can be seen that the depth of cavity 32 for a 30 to 90 MHz antenna is on the order of 32 inches, with the horizontal dimensions of the antenna being 64" by 64". The antenna pattern at 30 MHz is illustrated by loop 34, whereas the antenna pattern at 500 MHz is shown by the lobes 36. The reason for the production of the lobes is the depth of the cavity which has multiple resonances or exhibits multiple resonant wavelengths as the frequency decreases and the cavity depth increases. Note that the depth of the cavity is such that straight above the cavity reflections from the bottom of the cavity are out of phase with the direct wave from the antenna. E. g., at 500 MHz the cavity depth is about one wavelength, resulting in a null straight up. There is also a null at a lower elevation angle, e.g., 30 degrees. In order to provide for the ultra bandwidth and ratios exceeding 15:1, the subject invention involves nesting of the previously-described cavity embedded meander line antennas, with each antenna treated as an antenna module having the appropriate cavity depth so as not to have the above-mentioned out-of-phase condition. Thus, each nested module has its own loop type antenna characteristic, with the depth of the cavity for the lowest frequency module not present for modules operating at a higher frequency band. As will be appreciated, modules operating at a higher frequency band have shallower cavities and for its band do not result in out-of-phase cancellations which result in nulls.

Figure 3:
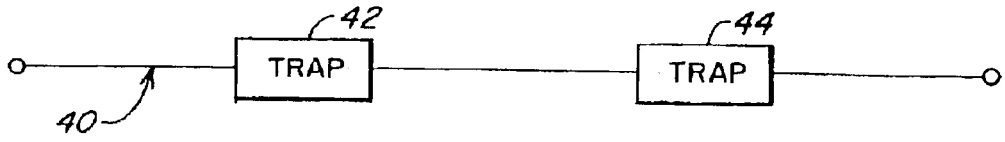
FIG. 3 is a schematic diagram of a trapped antenna configuration in which each of the segments of the antenna is provided with a trap between it and the next adjacent segment, with the antenna providing coverage over different bands.

Referring to FIG. 3, in order to provide for the wideband frequency coverage, the subject antenna may be likened to a beam antenna 40 with traps 42 and 44 that divide up the resonant frequency response of the antenna element into a number of subbands.

Figure 4:
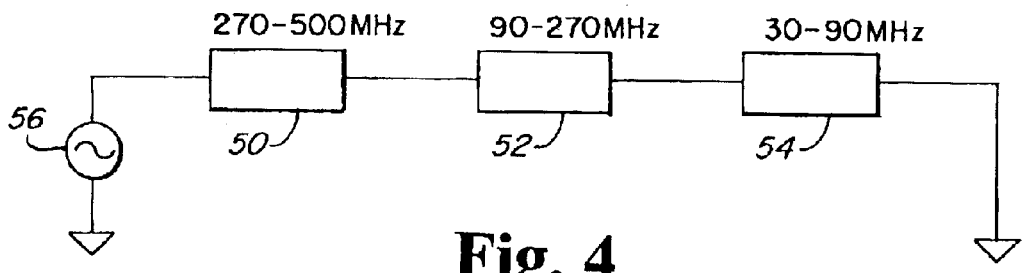
FIG. 4 is a diagrammatic illustration of the operation of the cavity embedded meander line loaded antennas illustrating that the common feed for the antennas is such that the meander line loaded antenna module for the 270 to 500 MHz band precedes the 90 to 270 MHz band module, which in turn precedes the 30 to 90 MHz band module.

Referring to FIG. 4, if the nested cavity embedded meander line loaded antenna modules have 270 to 500 MHz band as illustrated by module 50, a 90 to 270 MHz band as illustrated by module 52 and a 30 to 90 MHz band by module illustrated at 54, when these modules are coupled in series with a signal source 56 to ground, then assuming the signal source outputs a frequency between a 270 and 500 MHz, module 50 will radiate all this energy, leaving virtually no energy to be radiated by modules 52 and 54. Likewise, if the signal source 56 outputs a frequency between 90 and 270 MHz, then modules 50 and 54 will radiate virtually nothing, whereas module 52 will radiate the majority of the energy. Finally, when signal source 56 outputs signals in the 30 to 90 MHz band, then module 54 performs the majority of the radiating, whereas modules 50 and 52 will radiate virtually no energy.

Figure 5:
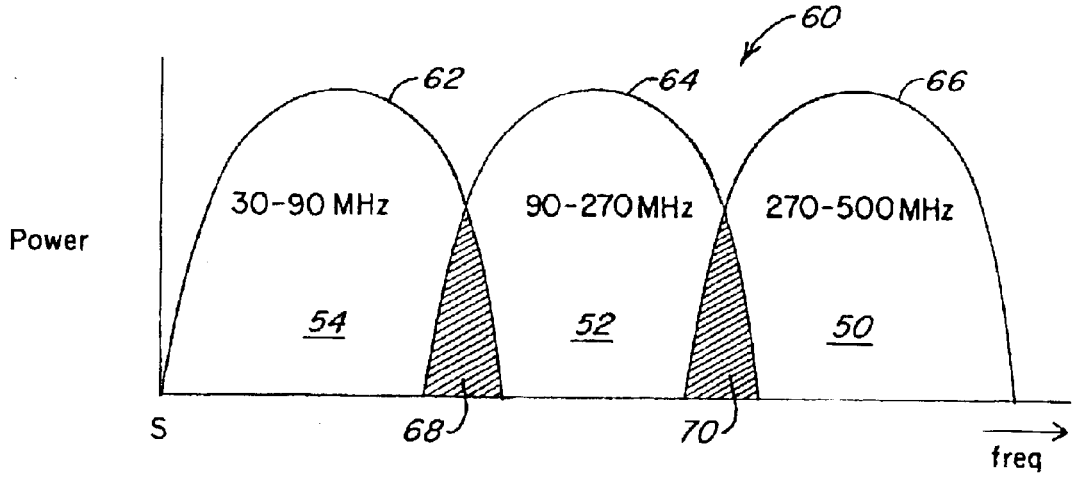
FIG. 5 is a waveform diagram illustrating the overlap in the response of the antenna modules of FIG. 4, illustrating an area at which frequency overlap can cause frequency domain distortion.

Referring to FIG. 5, a power versus frequency waveform 60 is illustrated. Here the response of the 30 to 90 MHz module 54 is illustrated by waveform 62, the response for the 90 to 200 MHz module 52 is illustrated at 64, and the response for the 270 to 500 MHz module 50 is illustrated at 66.

However, between the adjacent bands the will be an area of overlap, here illustrated at 68 and 70. It is important that these overlapped regions not produce a multi-lobe pattern.

It is the finding of the subject invention that the subject nested cavity embedded meander line loaded antenna modules do not have significant interference in the overlapped regions, such that the characteristic antenna lobe from the lowest frequency to the highest frequency is a single lobe or loop.

Figure 6:
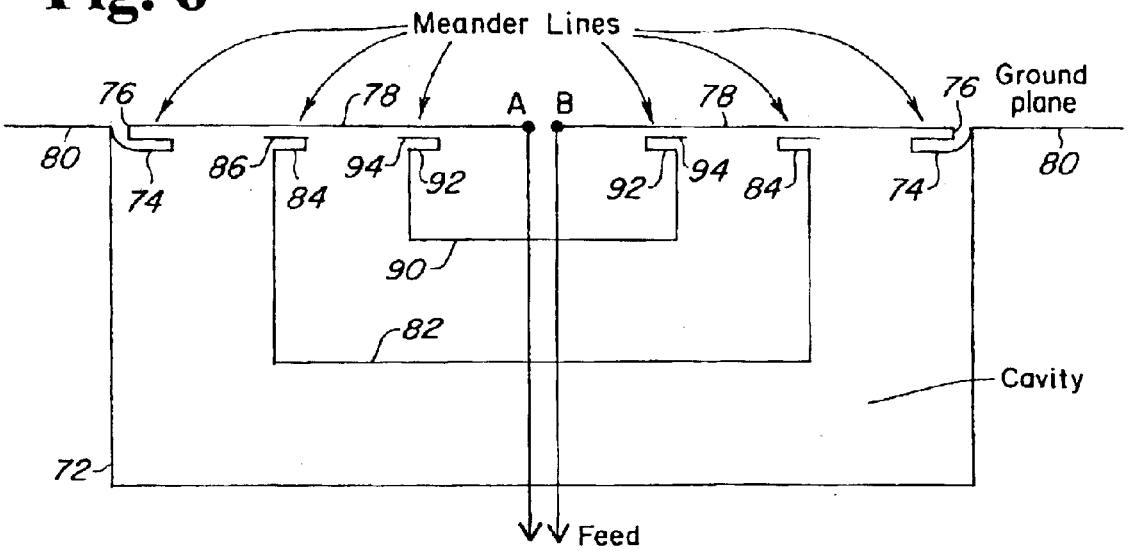
FIG. 6 is a schematic and side view of the subject cavity embedded nested meander line loaded antenna, illustrating the nesting of a number of cavities starting from the highest frequency band antenna down to the lowest frequency band antenna, showing both capacitive and direct feed coupling of the meander lines to the ground plane serving as the face of the antenna.

How this is accomplished is a result of the use of the nested configuration shown in FIG. 6, in which the array is nested, but has a common feed.

For the 30 to 90 MHz band, a cavity 72 is provided with a meander line 74 that is directly connected at 76 to a ground plane plate 78 shown as being bifurcated into a left hand portion and a right hand portion. The top periphery of cavity 72 is directly connected to ground plane 80 which surrounds the aperture of the nested antennas. For the 90 to 270 MHz band, a cavity 82 is nested within cavity 72, with cavity 82 having a meander line 84 capacitively coupled to ground plane plate 78. Here it can be seen that there is a space between the upper most portion 86 of the meander line and the bottom surface of plate 78.

For the 270 to 500 MHz band, a cavity 90 is provided with a meander line 92 having an upper element 94 capacitively coupled to plate 78.

Figure 7:
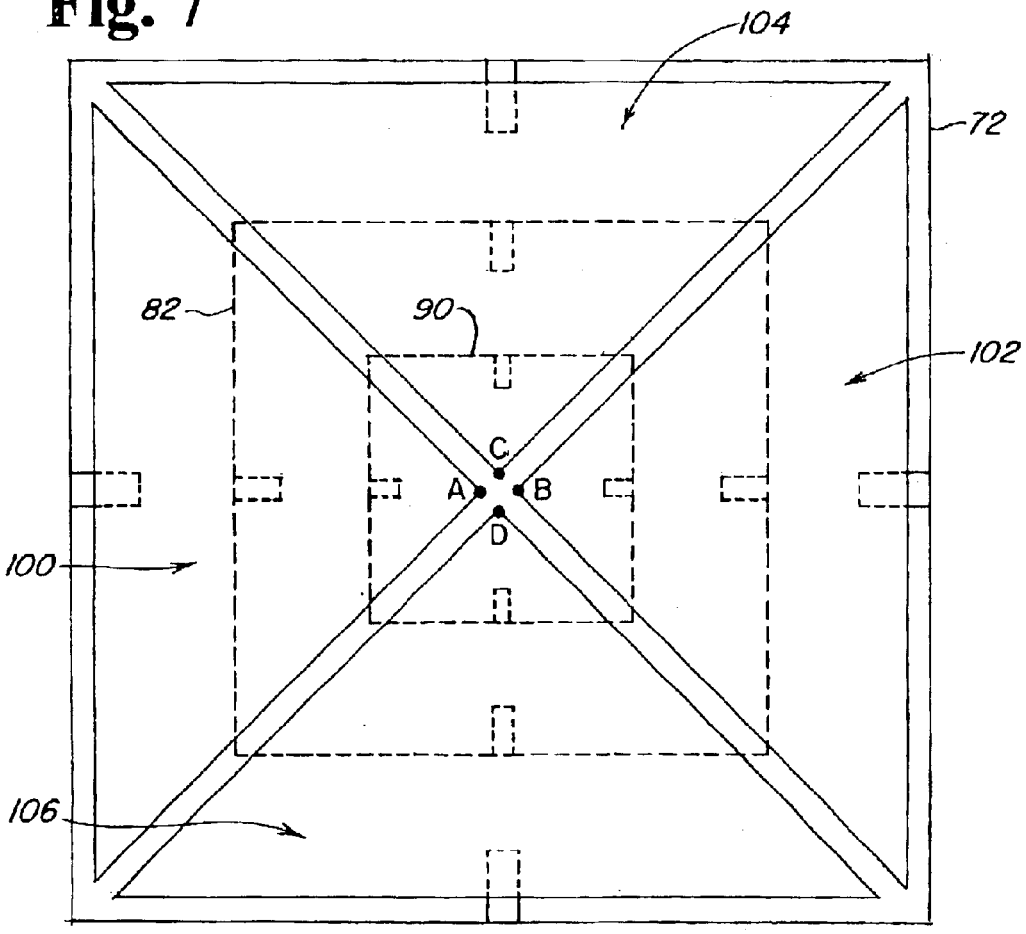
FIG. 7 is a top and schematic view of the antenna of FIG. 6, showing a quad ground plane arrangement fed such that the antenna has a horizontal polarization, a vertical polarization, and a right and left hand circular polarization.

When the antenna is to be operated in a quad fashion, and referring now to FIG. 7, bifurcated plate 78 is divided up into triangle shaped sections 100, 102, 104 and 106 as illustrated. Here the top periphery of cavity 72 is as noted, whereas the top peripheries of cavities 82 and 90 are illustrated by the associated dotted lines.

FIG. 7 constitutes a top view of the nested configuration in which the sides of the lowest frequency antenna module are 0.24λ, and where its depth is 0.088λ.

The utilization of this triangularly segmented quad configuration provides that the antenna may be feed so as to provide for a horizontal polarization, for a vertical polarization, or for a right hand and left hand circular polarization.

Referring back to FIG. 6, the common feed for all of the nested antenna modules shown as a balanced line connected to the bifurcated ground plane 78 at its most closely adjacent points A and B.

With respect to the quad configuration of FIG. 7, a balanced feed at points A and B results in a horizontal polarization, whereas a balanced feed at points C and D results in a vertical polarization. For a circular polarization one uses a 90° hybrid so that its input is a balanced line at inputs A and B and a balanced line at inputs C and D. The output of the hybrid results in right hand circular polarized and left hand circular polarized antenna patterns.

Figure 8:
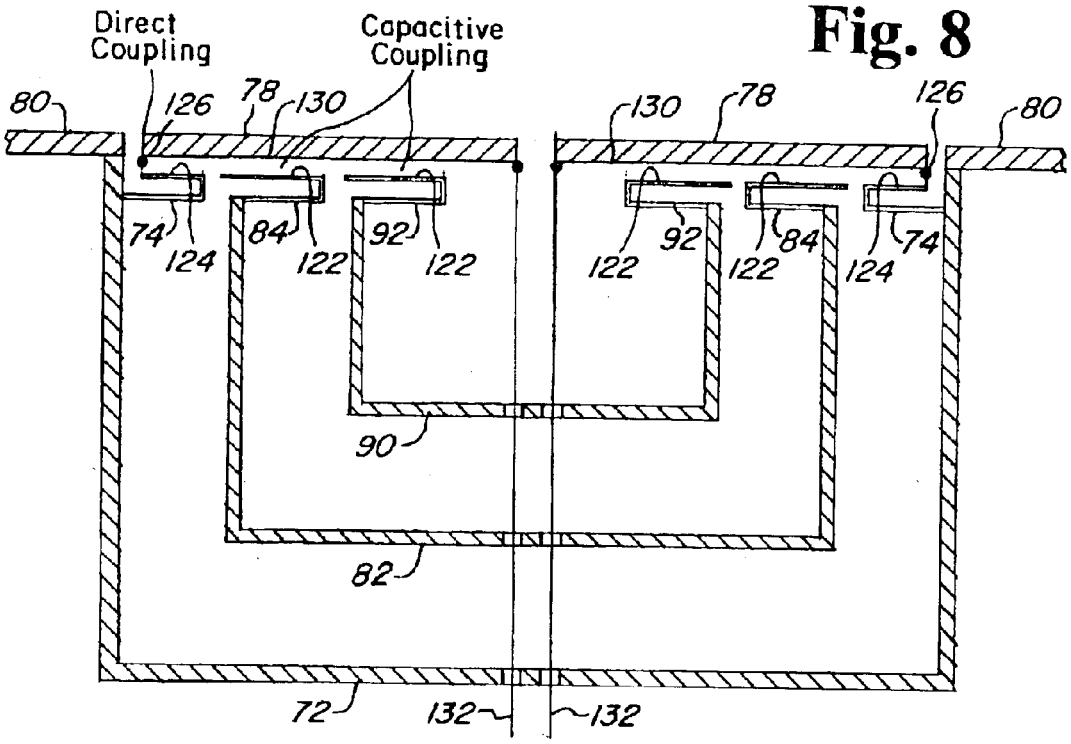
FIG. 8 is a sectional view of a nested cavity embedded meander line loaded antenna showing the nesting of the cavities which provide an ultra wide band response for the antenna.

Referring now to FIG. 8, in cross section the nested configuration of FIG. 6 includes cavities 72, 82 and 90 as illustrated, with the respective meander lines 74, 84 and 92 located at the top of the respective cavities.

Figure 10:
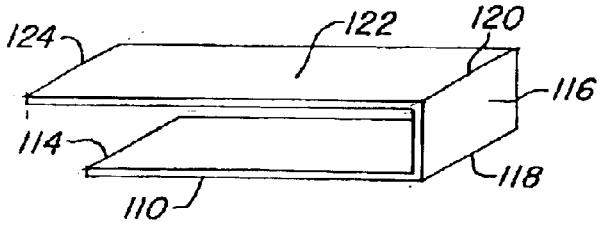
FIG. 10 is a diagrammatic illustration of a meander line for use with the nested cavity embedded meander line loaded antennas of FIG. 8; and, FIG. 11 is a diagrammatic illustration of the volume occupied by the nested meander line loaded antenna operating at between 30 to 500 MHz.

Here, and as illustrated in FIG. 10, the meander lines have a horizontally running section 110 coupled at an end 114 to the associated cavity. There is an up standing portion 116 at the other end 118 of section 110 that connects to an end 120 of a top portion 122 of the meander line. Each meander line has a top end 124 as illustrated. It will be seen that end 124 of meander line 74 is directly coupled to bifurcated plate 78. As illustrated at 126 this provides a direct coupling of the lowest frequency cavity embedded meander line loaded antenna module to the most distal portion of the bifurcated ground plate.

Capacitive coupling of meander line cavities 84 and 92 is the result of the spacing of top portion 122 from the lower surface 130 of bifurcated ground plate 78.

Each of the antenna modules has a common balanced feed here illustrated by balanced line 132 coupled across opposed points A and B of the bifurcated ground plate 78. It will also be noted that the top periphery of cavity 72 is directly connected to the surrounding ground plane 80.

Figure 9:
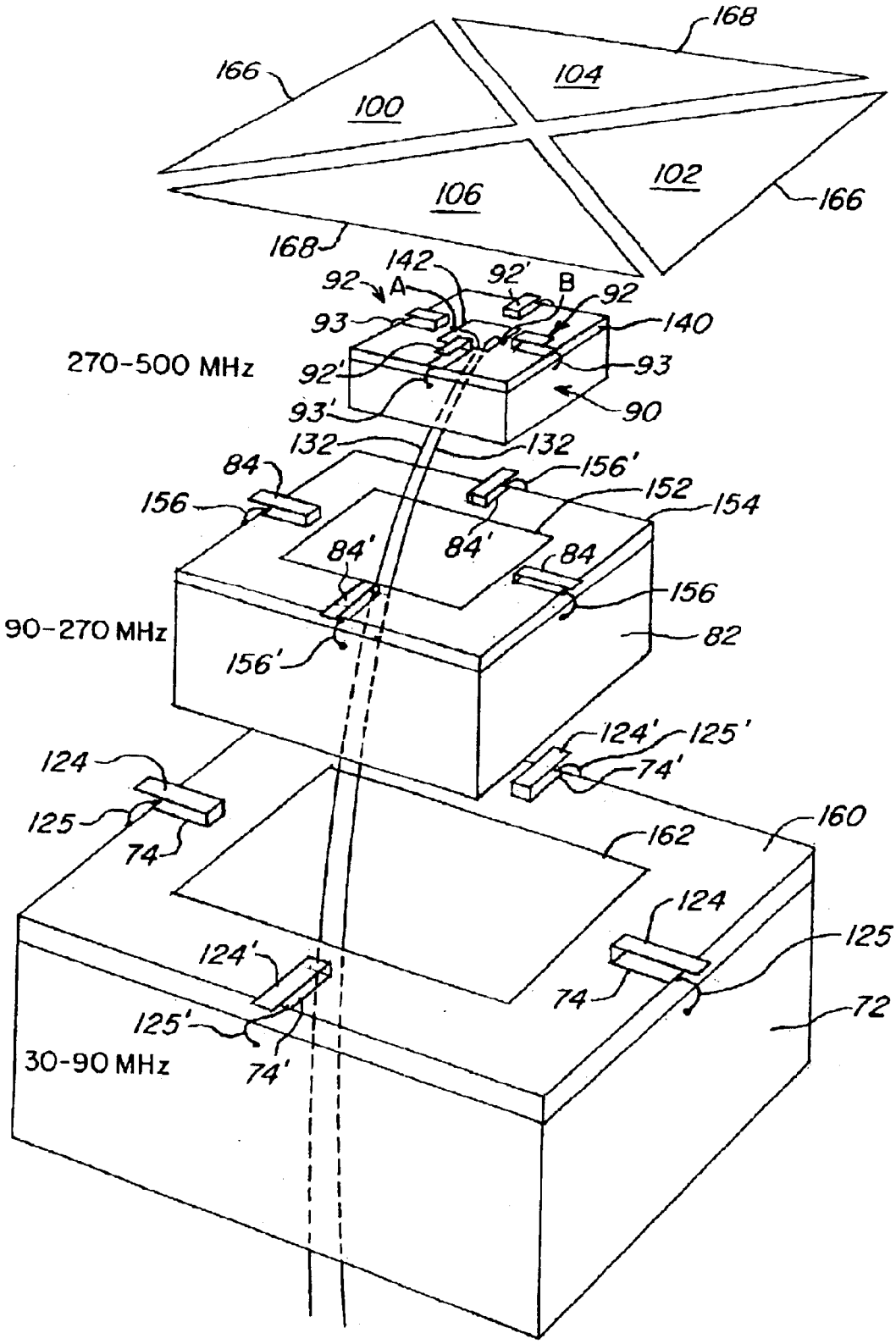
FIG. 9 is an exploded view of the cavity embedded meander line loaded antenna structure of FIG. 8 showing the nesting and embedding of the cavities beneath a quad ground plane structure.

Referring now to FIG. 9, in an exploded view the nested antenna module configuration is shown directly below the quad plate structure in which like reference characters represent like elements between FIGS. 7 and 9. Here the innermost cavity embedded meander lined loaded antenna module 90 is illustrated as having associated meander line structures 92 immediately below triangular plates 100 and 102. Note that the lower portion of the meander line is coupled by conductor 93 to cavity 90.

To address the quad structure, meander lines 92' are situated respectively below plates 104 and 106. Each of the meander lines is mounted on an apertured dielectric support plate 140 having a central aperture 142 adapted to receive balanced lines 132 so that the distal ends thereof can be attached to points A and B as illustrated. Note that the lower portion of meander lines 92' are connected by conductors 93' to cavity 90.

As can be seen, the next lower frequency antenna module has a cavity 82 into which cavity 90 nests via insertion through aperture 152 in dielectric support plate 154. Here it can be seen that meander lines 84 rest on dielectric plate 154 and are attached to the corresponding cavity via conductors 156 or other means. This connects the cavity 82 module to respective plates 100 and 102, with meander lines 84' capacitively coupling this antenna module to the appropriate super positioned plates 104 and 106. Here conductors 156' connect the lower portions of meander lines 84' to cavity 82.

Finally, for the lowest frequency module here illustrated by cavity 72 the associated meander lines 74 are illustrated on top of a dielectric support plate 160, with plate 160 having a central aperture 162 to admit cavity 182 in a nesting relationship. Here, ends 124 of meander lines 74 are directly coupled to distal edges 166 of plates 100 and 102 respectively. The lower portions of meander lines 124 are coupled by conductors 125 to cavity 72.

Likewise, meander lines 74 have ends 124' directly coupled to distal edges 168 respectively of plates 104 and 106, with the lower portions thereof coupled by conductors 125' to cavity 72.

Figure 11:
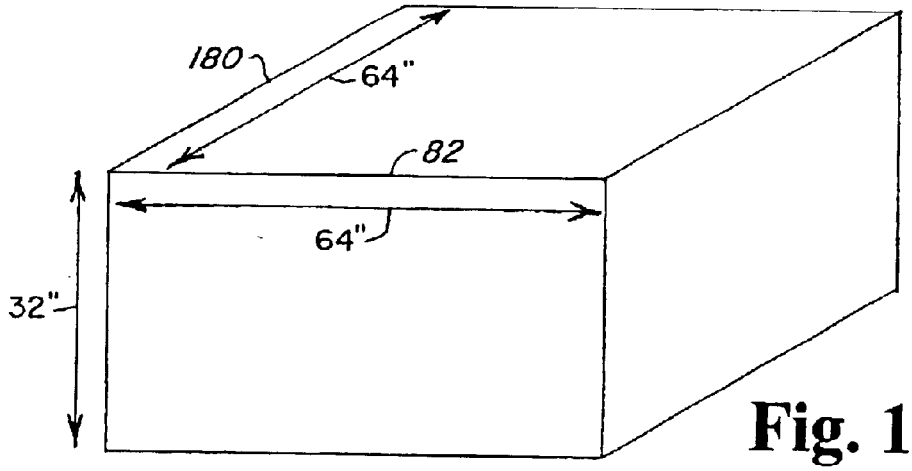

Referring now to FIG. 11, here can be seen that the exterior dimensions of the nested combination for the 30–500 MHz bandwidth are such that the length and width dimensions are 180 and 182 are 64 inches, whereas the depth of the cavity associated with the lowest frequency antenna module is 32 inches.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. An ultra wide band antenna, comprising:

a number of cavity embedded meander line loaded antenna modules having non-overlapping frequency bands of operation, each of said modules having an outer conductive cavity, and further including a ground plane plate above said cavities a meander line at the top of said outer conductive cavity having an end coupled to said cavity, and means for coupling an end of said meander line to said ground plane plate; and, a common feed to said modules.

2. The antenna of claim 1, wherein said modules are nested one within another.

3. The antenna of claim 1, wherein said modules are serially connected together.

4. The antenna of claim 1, wherein said coupling means includes a capacitive coupling between said meander line and said ground plane plate.

5. The antenna of claim 1, wherein said coupling means includes a conductor for coupling said meander line to said ground plane plate.

6. The antenna of claim 1, wherein said ground plane plate is divided into two sections and wherein said common feed is coupled across said two sections.

7. The antenna of claim 6, wherein said common feed includes a balanced line.

8. The antenna of claim 7, wherein said balanced line is connected across the closest adjacent points on said sections.

9. The antenna of claim 1, wherein said ground plane plate is divided into four sections and wherein said common feed is coupled across said sections to effectuate a predetermined polarization for said antenna.

10. The antenna of claim 9, wherein said polarization is selected from the group consisting of horizontal polarization, vertical polarization, right hand circular polarized and left hand circular polarization, polarized and left hand circular polarization.

11. The antenna of claim 1, wherein the antenna pattern is in the form of a loop across said bands of operation.

12. The method of claim 1, wherein the ultra wide band antenna is used for surveillance from an over flying platform.

13. A method of providing an ultra wide band antenna having a loop type antenna pattern over the bands of operation of the antenna, comprising the steps of:

nesting a number of cavity embedded meander line loaded antenna modules having different non-overlapping frequency bands of operation, each of said modules having an outer conductive cavity, and further including a ground plane plate above said cavities, a meander line at the top of said outer conductive cavity having an end coupled to said cavity, and means for coupling an end of said meander line to said ground plane plate; and, providing the antenna modules with a common feed, whereby any side lobes are minimized such that there is no significant null in a direction perpendicular to the face of the nested modules.

14. The method of claim 13, wherein the frequency bands of operation of the modules are contiguous and wherein any bandwidth overlap does not result in any substantial null in a direction perpendicular to the face of the nested modules.

15. The method of claim 13, wherein the modules are serially connected.

16. A compact flush-mountable ultra wide band antenna, comprising:

a number of nested cavity embedded meander line loaded antenna modules, each of said modules having an electrically conductive cavity having a top periphery, an apertured dielectric layer at said top periphery, at least one meander line on said dielectric layer and having an end electrically connected to said cavity, a ground plane plate above said meander line and a coupler for coupling another portion of said meander line to said ground plane plate, the aperture in said dielectric layer being of a size to permit the insertion of a smaller cavity therethrough to permit said nesting; and, a common feed for said antenna modules, said modules having substantially non-overlapping bands of operation.

17. The antenna of claim 16, wherein said ground plane plate is divided into sections and wherein said feed includes a pair of conductors coupled to different sections.

18. The antenna of claim 17, wherein said ground plane plate is divided into four sections such that said antenna can be driven so as to provide a horizontally polarized, a vertically polarized, a right hand circularly polarized and left hand circularly polarized antenna pattern.

19. The antenna of claim 18, wherein said sections are triangularly shaped.

* * * * *